United States Patent [19]

Nishikawa et al.

[11] Patent Number: 4,620,491

[45] Date of Patent: Nov. 4, 1986

[54] METHOD AND APPARATUS FOR SUPERVISING COMBUSTION STATE

[75] Inventors: Mitsuyo Nishikawa, Hitachi; Nobuo Kurihara, Hitachiohta; Yoshio Sato, Hitachi; Atsumi Watanabe, Hitachi; Toshihiko Higashi, Hitachi; Hisanori Miyagaki, Hitachiohta; Atsushi Yokogawa, Hitachi; Yoshihiro Shimada, Izumi, all of Japan

[73] Assignee: Hitachi, Ltd., Tokyo, Japan

[21] Appl. No.: 726,392

[22] Filed: Apr. 23, 1985

[30] Foreign Application Priority Data

Apr. 27, 1984 [JP] Japan ..... 59-83782
May 11, 1984 [JP] Japan ..... 59-92872
May 21, 1984 [JP] Japan ..... 59-100538

[51] Int. Cl.[4] ..... F23M 5/00

[52] U.S. Cl. ..... 110/185; 110/186; 110/347; 236/15 BA; 431/79

[58] Field of Search ..... 110/185, 186, 347; 431/79; 236/15 BA, 15 R

[56] References Cited

U.S. PATENT DOCUMENTS

| | | | |
|---|---|---|---|
| 3,894,834 | 7/1975 | Estes | 110/185 X |
| 4,039,844 | 8/1977 | MacDonald | 431/79 X |
| 4,233,596 | 11/1980 | Okamoto et al. | 431/79 X |
| 4,368,031 | 1/1983 | Chadshay | 110/185 X |
| 4,435,149 | 3/1984 | Astheimer | 431/79 X |

*Primary Examiner*—Edward G. Favors
*Attorney, Agent, or Firm*—Antonelli, Terry & Wands

[57] ABSTRACT

This invention relates to the supervision of a combustion state of a combustion furnace. A flame formed concentrically with the direction of a fuel jetted from a burner being the center is measured from its side, and two oxidizing flame zones as high luminance zones are extracted. Using the shape parameters of the flame, an index for reducing NOx and unburnt components in ash are calculated and estimated so as to supervise the combustion state. The positions or centroids of the flames and the distance between the centroids are used as the shape parameters, and the flame shape is divided into two zones for easy display of each zone.

17 Claims, 20 Drawing Figures

FIG. 7
(c)
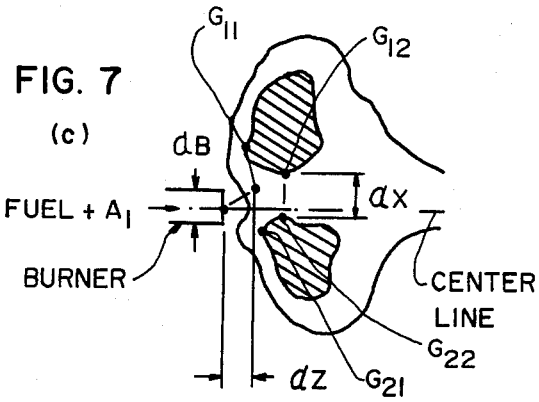
$G_{11} \cdot G_{21}$: THE OXIDIZING FLAME EDGE CLOSER TO THE BURNER
$G_{12} \cdot G_{22}$: THE OXIDIZING FLAME EDGE CLOSER TO THE CENTER LINE
FIG. 8
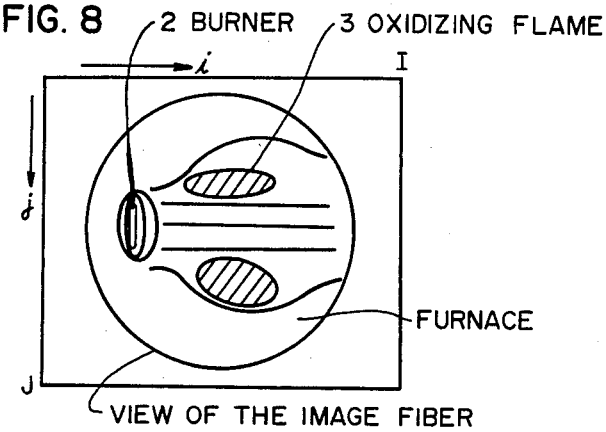
FIG. 10
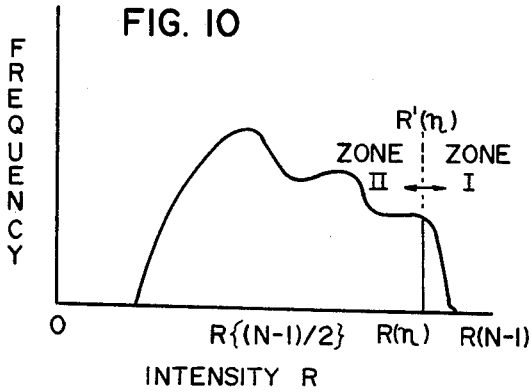
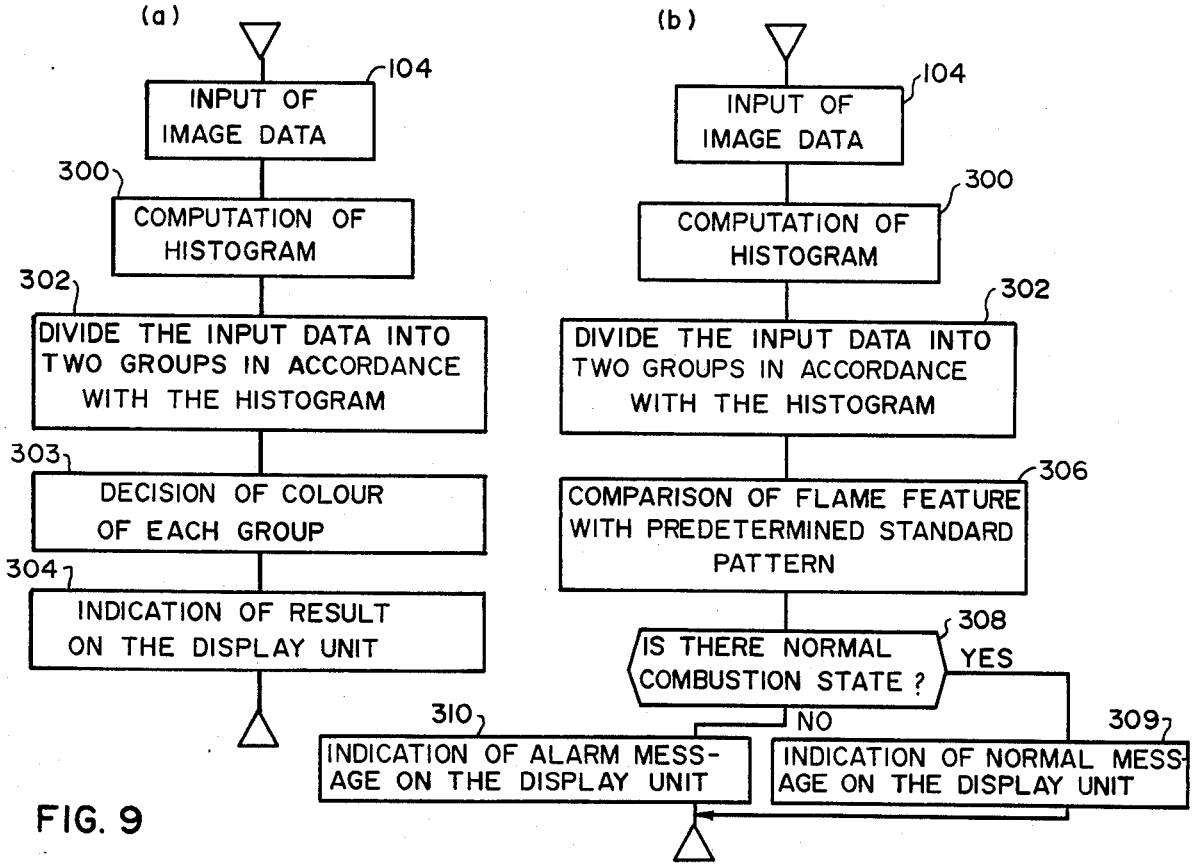
FIG. 9

METHOD AND APPARATUS FOR SUPERVISING COMBUSTION STATE

BACKGROUND OF THE INVENTION

1. Field of the Invention

This invention relates to a method and apparatus for supervising the combustion state inside a combustion furnace such as a boiler for thermal power generation.

Supervision of $NO_x$ formed during combustion of dust coal or CWM (coal water mixed), or unburnt components in ash is extremely important in order to keep a satisfactory combustion state. This is also extremely significant for the effective utilization of fuels. Efficient combustion and minimization of deterimental components in the exhaust smoke are important factors that determine a good combustion state.

The present invention relates to supervision technique in this field of combustion.

2. Description of the Prior Art

As a new lock has been taken at coal as an alternative energy source to petroleum, combustion technique of dust coal has drawn increasing attention. Although the combustion technique of dust coal itself is said to have reached completion, novel technique has become necessary in recent years to cope with severe official restrictions on the exhaust of air-polluting matters.

A dust coal fuel has a greater N content than liquid fuels such as heavy oil, naphtha, and the like, and hence generates a higher concentration of nitrogen oxides (hereinafter referred to as "NOx" that result in the air pollution upon combustion. Furthermore, fuel NOx that is formed due to the combination of the nitrogen molecules in the fuel with the oxygen molecules in the air for combustion does not much depend upon the combustion temperature in comparison with thermal NOx formed due to the dissociation and combination of the nitrogen and oxygen molecules in the air for combustion, or with prompt NOx formed due to the combination of hydrocarbons in the fuel with the oxygen molecules in the air for combustion. From this aspect, means for reducing the resulting NOx to $N_2$ and the like is believed rather necessary than a combustion method which does not generate NOx, in order to reduce NOx of dust coal combustion. Since the dust coal fuel has many factors relating to its properties such as a fuel ratio, an ash content, a viscosity, a particle size distribution, and so forth, remarkable fluctuation occurs in the combustion process. Changes with time such as in pulverization, transportation, jetting by a burner, and the like, can not be neglected in comparison with combustion equipment for heavy oil, naphtha, LNG, and the like.

As described above, a combustion method which takes into consideration (i) a reducing effect of NOx and (ii) the changes of combustion must be developed in order to realize low NOx combustion of dust coal.

The increase of unburnt components in the ash reduces a boiler efficiency and imposes various limitations on the processing of waste. When high fuel ratio coal (solid carbon/volatile components) and low grade coal are used, means for reducing the unburnt components in the ash must be developed.

On the other hand, the combustion process of dust coal particles is such that decomposition and combustion of volatile components proceed at the initial stage of combustion, and then the surface combustion of coke-like residual carbonaceous matters (hereinafter referred to as "char") proceeds. The surface combustion of the char is somewhat slower than the decomposition combustion of the volatile components, and the most of the time required for complete combustion are believed to be used for the surface combustion of the char.

Therefore, it is extremely difficult to estimate the unburnt components in the ash during the combustion process because of a large number of factors relating to the properties of the dust coal such as the fuel ratio, the ash content, the viscosity, the particle diameter distribution, and so forth.

However, it is empirically obvious that combustion be made immediately inside a furnace in the presence of excessive oxygen ($O_2$) and in a high temperature atmosphere in order to reduce the unburnt components in the ash, but such an operation method involves the problems of control and safety.

In existing business or industrial dust coal-fired boilers, the boiler operation is carried out in such a manner as to minimize the unburnt components in the ash to improve the boiler efficiency, but if a two-stage combustion method or a slow combustion method effective for gas- and oil-fired boilers is employed, the temperature inside the furnace tends to drop and the unburnt components in the ash tend to increase, on the contrary.

A supervision method which supervises the flame at the time of combustion using an ITV (industrial television) mounted to the opposed wall of a burner or a method inspecting the combustion state from a peep hole formed on a furnace wall has been employed in the past to determine the combustion state inside the furnace. However, either method merely supervises the combustion flame alone.

An automated supervision method uses a flame detector, but this method merely supervises ignition or extinguishment. In other words, this method is not a determined combustion supervision method, and inevitably relies upon the experience and skill of a furnace operator.

One of the conventional supervision methods is disclosed in U.S. Pat. No. 3,842,391 (entitled "Method and apparatus for flame monitoring", July 16, 1974). This prior art relates to a method and apparatus for monitoring the flame of a furnace using a plurality of burners such as a thermal generation boiler. This method uses two photosensors to optically monitor the flame of a selected burner from a plurality of burners. A signal having an a.c. component corresponding to the change of intensity of radiation from the flame is detected by the two sensors, and the degree of correlation is determined.

U.S. Pat. No. 4,403,941 (entitled "Combustion process for reducing nitrogen oxides", Sept. 13, 1983) discloses denitrating by combustion, but does not at all teach the supervision of the combustion state using flame-relating data. The reference describes only the reduction of NOx by multi-stage combustion.

U.S. patent application Ser. No. 527,847 (Aug. 30, 1983) filed previously by the Applicant of the present invention specifically deals with the shape of the flame. This prior application contemplates to diagnose the combustion state from parameters representing the shape of the root portion of the flame. The correlation between the shape of the flame root and the combustion state is stored in advance, and judgement is then made to which pattern the measured flame shape belongs, thereby diagnozing the combustion state. The present invention provides a combustion state supervising system as a result of a further improvement in this prior invention.

As to the physico-chemical behavior of combustion of dust coal, mention can be made of W. R. Seeker et al., "The Thermal Decomposition of Pulverized Coal Particles" (Eighteenth Symposium-International-On Combustion, The Combustion Institute, 1981, pp. 1213–1226).

SUMMARY OF THE INVENTION

It is an object of the present invention to provide a method and apparatus for supervising the unburnt components in ash during combustion of dust coal.

It is another object of the present invention to provide a method and apparatus for supervising the quantities of NOx during the reducing combustion of dust coal.

It is still another object of the present invention to provide a method and apparatus which measures the combustion flame and dividedly displays the combustion state in accordance with the luminance or temperature of the flame.

The present invention is characterized in that a flame image in the proximity of a burner outlet is measured, an oxidizing flame is extracted as a high luminance zone, parameters relating to the degree of reduction of NOx are calculated from the shape of the oxidizing flame thus extracted, and the formation quantities of NOx are estimated and supervised from the parameters thus calculated.

The present invention is further characterized in that the positions of the centroids of the oxidizing flames, the distance between the centroids and the thickness of the oxidizing flames are employed as the parameters of the flame shape that are associated with the degree of reduction of NOx.

Still another characterizing feature of the present invention resides in that the unburnt components in ash are estimated on the basis of the flame shape parameters described above.

Still another characterizing feature of the present invention resides in that a measured flame is divided into at least two zones and is displayed for each zone, and the combustion state is supervised from the area of each zone or from the relation between the area ratio and a load (or a fuel), on the basis of the fact that a correlation exists between the luminance or temperature of the flame and the load (or the fuel), as described above.

BRIEF DESCRIPTION OF THE DRAWINGS

FIG. 8 is an explanatory view for explaining luminance data by an image fiber;

FIGS. 9(*a*) and 9(*b*) are flow charts showing the flow of processing;

FIG. 10 is an explanatory view of two zone division in accordance with luminance;

DESCRIPTION OF THE PREFERRED EMBODIMENTS

First of all, the fundamental subject of the present invention will be described.

Figure 1:
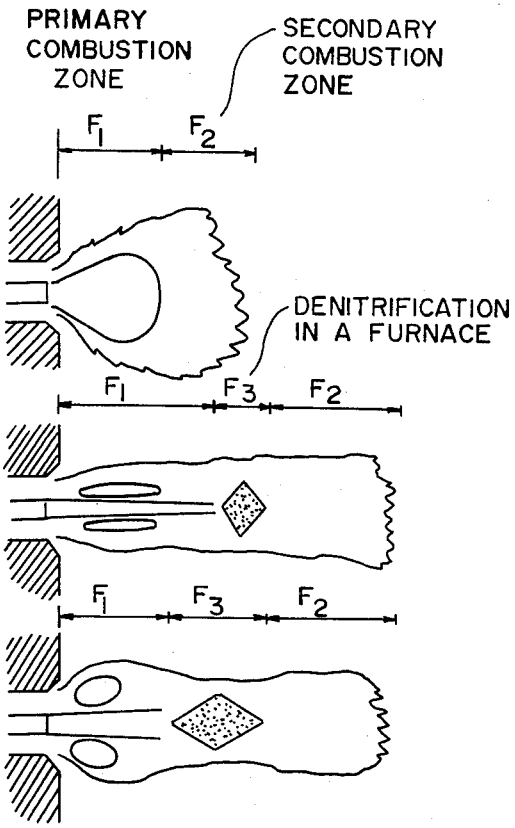
FIG. 1 is an explanatory view of some typical shapes of flames in dust coal combustion.

FIG. 1 shows typical flame shapes in the case of combustion of dust coal, wherein FIG. 1(*a*) shows a flame having an extremely high NOx concentration, 1(*b*) does a flame having an intermediate NOx concentration between (*a*) and (*c*), and 1(*c*) does a flame having a low NOx concentration. The flame, that is, the combustion zone of the dust coal, can be divided into a primary combustion zone $F_1$ where combustion of volatile components primarily occurs, a secondary combustion zone where combustion of the char (solid carbon content) primarily occurs, and a denitrification zone $F_3$ where the reducing action is promoted. The sizes of these zones have an extremely close correlation with the concentration of resulting NOx. In FIG. 1(*a*), the denitrification zone $F_3$ does not exist, but in FIG. 1(*b*), it is formed between the primary combustion zone $F_1$ and the secondary combustion zone $F_2$. In FIG. 1(*c*), the primary combustion zone $F_1$ becomes thick and short, and the denitrification zone $F_3$ becomes wide as much.

The present invention makes the most of the phenomenon that when the primary combustion zone $F_1$ at the time of combustion of the dust coal becomes thick and short, the NOx reducing effect becomes more remarkable. This phenomenon can be qualitatively explained as follows.

When the dust coal is sprayed into the furnace which is in the high temperature atmosphere, ignition takes place first on the surface. As the dust coal is heated due to this surface combustion, the volatile components contained in the dust coal are separated and diffused to the portions nearby, so that the primary cumbustion zone is formed. In this primary combustion zone, large quantities of NO are formed due to the reaction of the following formula (1):

$$N_2\text{ (volatile N components)} + O_2 \rightarrow NO \quad (1)$$

On the other hand, .HC occurs from the center of the heated flame, and the reaction of the following formula (2) takes place:

$$NO + .HC \rightarrow .NX \quad (2)$$

where .NX is either .NH or .CN.

This .NX reduces NO in the subsequent denitrification zone in accordance with the following formula (3):

$$.NX + NO \rightarrow N_2 \quad (3)$$

However, this .NH as the reducing agent for NOx results in the increase in NO, on the contrary, if oxygen exists.

$$.NX + O \rightarrow NO \quad (4)$$

Therefore, the essential point of the low NOx combustion is that the volatile components should be burnt close to a burner, and the center of the flame should be kept at a high temperature and in an oxygen-lean state. This combustion method is extremely effective for reducing NOx because the most of NOx formed by the combustion of the dust coal result from the combustion of the volatile components and the formation of NOx by the combustion of the char is less. From the aspect of the flame shape, the flame shape in the primary combustion zone is thick because the combustion of the volatile components is promoted and moreover, the diffusion of the air into the center portion of hte flame is reduced. In addition, because the air quantity is reduced as a whole in order to keep the denitrification zone in the oxygen-lean state, the flame becomes short in the primary combustion zone.

The index $I_{NOx}$ for the low NOx combustion on the basis of the observation described above will be explained with reference to FIG. 2.

A zone of the flame close to a burner and having high luminance will be hereinafter referred to as an "oxidizing flame", and the index $I_{NOx}$ representing the degree of NO reduction will be defined as $$I_{NOx} = X_1^{-1} \cdot X_2 \cdot X_3^{-1} \quad (5)$$

where $$X_1\text{: position of centroid} = d_z/d_B \quad (6)$$

$$X_2\text{: distance between centroids} = d_x/d_B \quad (7)$$

$$X_3\text{: thickness} = l_F/S_F \quad (8)$$

Figure 2:
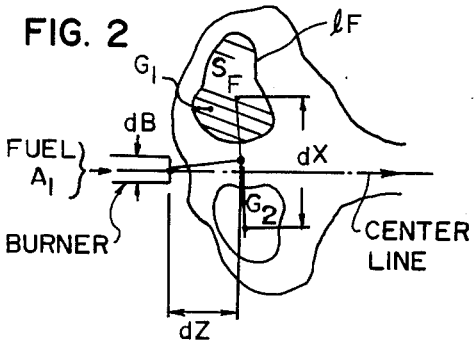
FIG. 2 is an explanatory view for explaining flame shape parameters.

$d_B$: throat diameter, $l_F$: surrounding length, $S_F$: area (hatched portion in FIG. 2)

Figure 3:
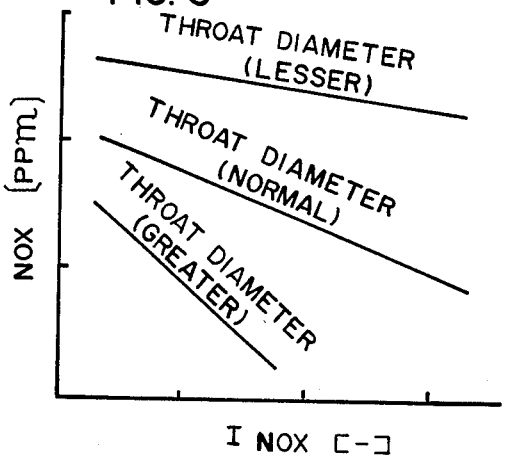
FIG. 3 is a diagram showing the relation between NOx-reducing factors and NOx.

FIG. 3 shows NOx-vs-$I_{NOx}$ characteristics obtained from the result of combustion tests. The present invention determines in advance the characteristics, and estimates the quantity of the resulting NOx in combustion by actually measuring $I_{NOx}$.

One embodiment of the present invention will be described with reference to FIGS. 4(*a*), 4(*b*) and 5. An apparatus for supervising the combustion state in accordance with the present invention comprises image guides 11-1, 11-2, ITV cameras 12-1, 12-2, changing means for channels 13, an A/D convertor 14, a frame memory 15, a processor 16 and a display 17. The image guide 11 is mounted to a peep hole of the boiler 1 so that the flame images close to the dust coal burners 2 (2-1, 2-2, 2-3) can be measured. The head portion of the image guide 11 is cooled by water or air so that the image guide can withstand a high temperature atmosphere, and the air is jetted from the outer periphery of the front surface of the image guide 11 in order to prevent the deposition of the combustion ash of the dust coal.

The optical image data 100-1, 100-2 of the flame are converted to electric signals by the ITV cameras 12 (12-1, 12-2), and are sent as analog image signals 101 (101-1, 101-2) to the changing means for channels 13. This means 13 sends the analog image signal 102 of the designated channel to the A/D convertor 14 in accordance with the channel selection signal 105 that is produced from the processor 16. After the signal is converted to a digital image signal 103 by the A/D convertor 14, the designated flame image data is stored in the frame memory 15. The processor 16 calculates $I_{NOx}$ defined by the formula (5) using this flame image data, and further estimates the resulting NOx value formed from the burner using the NOx-$I_{NOx}$ characteristics of FIG. 3. The sequence of processings by this processor 16 is shown in FIG. 5.

Figure 5:
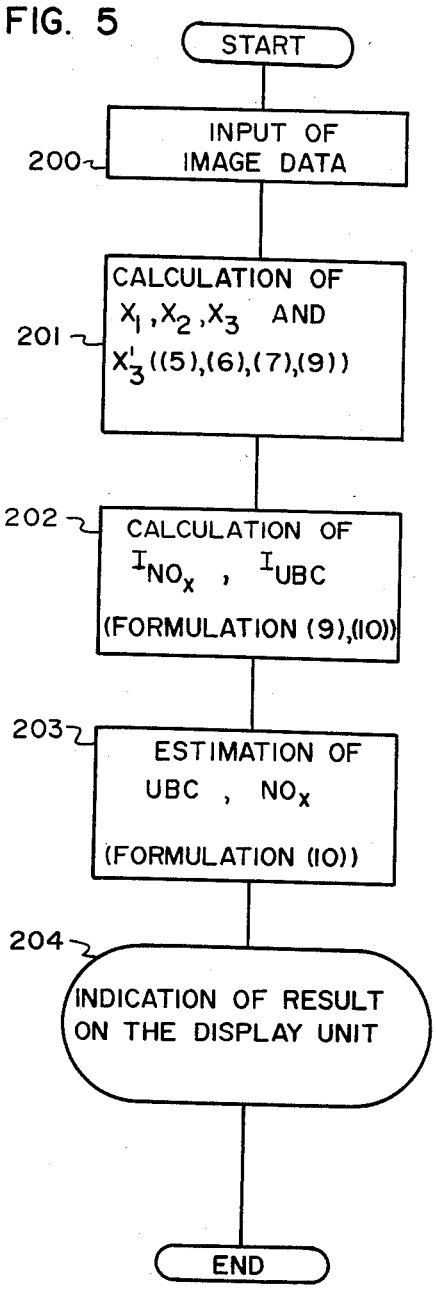
FIG. 5 is a flow chart showing the sequence of processing in a processor in the present invention.

In FIG. 5, the following operations are carried out.

(1) At a flame image data input step 200, the flame image data of the designated channel are taken into frame memory.

(2) At a flame shape feature extraction step 201, the coordinates of centroid and the surrounding length are calculated in accordance with the sequence represented by $X_1$, $X_2$ and $X_3$.

(3) At an $I_{NOx}$ calculation step 202, calculation is conducted in accordance with the formula (5).

(4) At a NOx estimation step 203, the $I_{NOX}$ value is converted to the NOx value using the NOx-vs-$I_{NOx}$ characteristics and throat diameter that are stored in advance as a data table.

(5) At a display step 204, the flame image data of the frame memory, the channel number, the NOx value, the $I_{NOx}$ value and $X_1 \sim X_3$ are displayed on the display 205.

The operations (1) through (5) described above are repeated until all the channels are completed.

This embodiment makes it possible to obtain the NOx value in each burner of the boiler.

In accordance with the embodiment described above, the NOx value formed by the combustion of the dust coal can be measured in a burner unit, so that the following effects can be obtained.

(1) It is possible to keep appropriate the combustion state in the burner such as the air distribution to the primary and secondary combustion zones and a revolving intensity when spraying the air.

(2) Any imbalance of the combustion state between the burners can be grasped.

(3) The changes of the combustion state due to the changes with time of the load, fuel properties, equipment, and the like, can be detected.

Turning back again to FIG. 1, the flame will be examined from the aspect of the unburnt components in ash. FIG. 1(*a*) shows a flame in which the quantity of the unburnt components in ash is extremely small, FIG. 1(*b*) shows a flame in which the quantity is extremely great, and FIG. 1(*c*) shows a flame in which the quantity of the unburnt components in ash is in between FIGS. 1(*a*) and 1(*b*).

The flame, that is, the combustion zone of the dust coal, can be divided broadly into the primary combustion zone $F_1$ where the combustion of the volatile components is predominant, and the secondary combustion zone $F_2$ where the combustion of the solid carbon content is principal. The sizes and positions of these zones are extremely closely associated with the quantity of the unburnt components in ash. These relations are (a) the flame in the primary combustion zone is great, (b) the flame in the primary combustion zone is small, and (c) the size of the flame in the primary combustion zone is in between (a) and (b).

In the case of (a), the dust coal is fed and suitably diffused into the furnace kept in a high temperature atmosphere so that the $O_2$ distribution around the dust coal particles becomes optimal, and the ignition of the volatile components is accelerated. While the high temperature atmosphere is maintained, the dust coal particles are rapidly burnt, thereby minimizing the unburnt components in ash.

In the case of (b), the distribution of the dust coal is separated from that of $O_2$, and since the combustion proceeds only in their contact zone, the dust coal particles that are not fully burnt remain in large quantities as the unburnt components.

In the case of (c), the secondary air is whirled and scatters the dust coal in the proximity of the burner tip so as to optimize the distribution of $O_2$ and to promote the combustion, and since a negative pressure develops at the downstream portion of the dust coal due to the whirl, the dust coal and $O_2$ are mixed together and the combustion proceeds. The unburnt components in ash are believed to fall between (a) and (b).

On the basis of the phenomenon that the size of the flame in the primary combustion zone and the combustibility from the burner tip portion are effective for reducing the unburnt components in ash, $I_{UBC}$ as the parameter for reducing the unburnt components in ash is defined, for example, as follows.

In addition to $X_1$ and $X_2$ in the afore-mentioned formulas (6) and (7), the primary air quantity is defined as $$\text{primary air quantity } X_3' = A_1 \tag{9}$$

The reducing index $I_{UBC}$ for the unburnt components in ash is defined as follows using $X_3'$:

$$I_{UBC} = k \cdot X_1^{-1} \cdot X_2^{-1} \cdot X_3' \tag{10}$$

where k is a coefficient.

Furthermore, it is possible to use the following parameters which represent the oxidizing flame. As a method of determining $G_1$ and $G_2$ representing $X_1$ and $X_2$ in FIG. 2, the following may be considered.

(1) $G_1$ and $G_2$ may be set to the center of the oxidizing flame.

(2) $G_1$ and $G_2$ may be set to the positions at which $X_1$ is closest to the oxidizing flame from the burner tip.

(3) $G_1$ and $G_2$ may be set to the positions of the highest temperature (or the positions of the highest luminance).

(4) The oxidizing flame is determined from the temperature distribution, and $G_1$ and $G_2$ may be set to its centroid.

Figure 6:
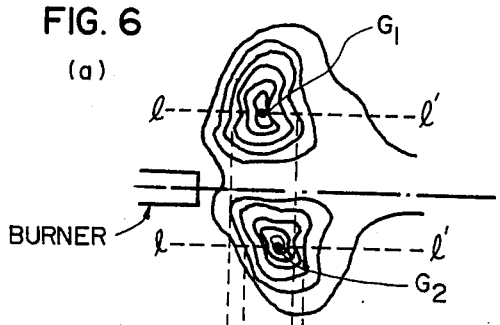
FIGS. 6(*a*) through 6(*c*) are explanatory views for explaining the shape and centroid of the flame.
Figure 6:
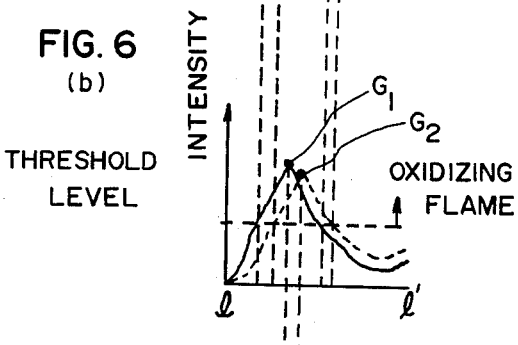
Figure 6:
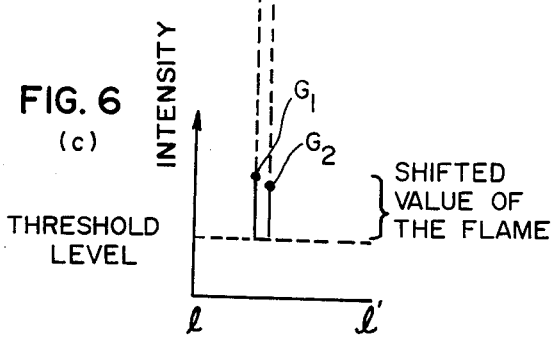

Furthermore, the thickness of the oxidizing flame may be considered as another parameter representing $X_3'$, but all these are the parameters that represent the position of the oxidizing flame from the burner tip and so far as it goes, the centroid need not necessarily be used. However, the distribution of the luminance (or temperature) of the oxidizing flame describes a contour line as shown in FIGS. 6(*a*) through 6(*c*), and its area changes in accordance with a limit value of the extraction of the high luminance zone. However, the position of centroid is hardly affected by its change. From this aspect, it is advisable to use the centroid as the parameter representing the oxidizing flame.

FIG. 6(*a*) shows the contour line of luminance, FIG. 6(*b*) shows the luminance characteristics on the section along the l—l' in FIG. 6(*a*), and FIG. 6(*c*) shows the point of centroid in FIG. 6(*a*).

Figure 4:
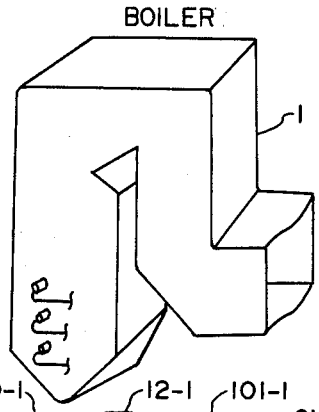
FIGS. 4(*a*) and 4(*b*) are block diagrams, wherein 4(*a*) shows specifically the appearance of a boiler.
Figure 4:
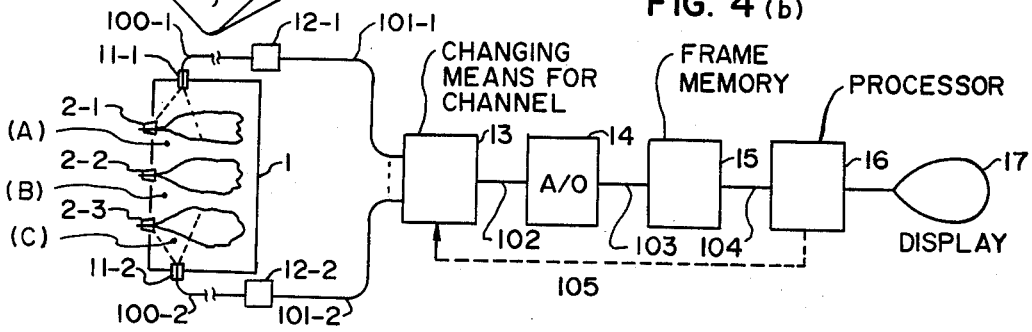

The processor 16 shown in FIG. 4 calculates the reducing index $I_{UBC}$ for the unburnt components in ash defined by the formula (9) by use of the image data stored in the frame memory 15 (at step 202 in FIG. 5), and estimates the unburnt components UBC in ash in accordance with the formula (10) (at step 203 in FIG. 5).

$$UBC = -K \cdot I_{UBC} \tag{11}$$

where K is a coefficient. A diagram prepared in advance by calculation may be used for the relation between $I_{UBC}$ and UBC. When a plurality of burners are to be supervised, the coefficient k in formula (10) and K in formula (11) assume different values from the coefficients when only one burner is used.

$I_{UBC}$ is calculated at step 202 in FIG. 5 in accordance with formula (10), and the unburnt components UBC in ash are estimated at step 203.

At the display step 204, the flame image used for the $I_{UBC}$ calculation, the parameters dZ, dX of the shape characteristics, $A_1$, $X_1$, $X_2$, $X_3$, the $I_{UBC}$ value, the estimated UBC value, and the like, are displayed on the display.

The processing described above is repeated either periodically or continuously, and the unburnt components in ash can be estimated with a high level of accuracy during the boiler operation, the high efficiency operation can be accomplished and the combustion state of the boiler can be supervised in a satisfactory manner.

Though the image data in this embodiment is a momentary value, the accuracy and stability can be further improved by using mean values of a plurality of images.

When the present invention is applied to the burner flames (A) through (C) of the stages shown in FIG. 4, the $I_{UBC}$ values can be expressed by the following formulas (10') and (11') with the respective suffixes:

$$\left.\begin{aligned} I_{UBC(A)} &= k_{(A)} \cdot X_{1(A)}^{-1} \cdot X_{2(A)}^{-1} \cdot X'_{3(A)} \\ I_{UBC(B)} &= k_{(B)} \cdot X_{1(B)}^{-1} \cdot X_{2(B)}^{-1} \cdot X'_{3(B)} \\ I_{UBC(C)} &= k_{(C)} \cdot X_{1(C)}^{-1} \cdot X_{2(C)}^{-1} \cdot X'_{3(C)} \end{aligned}\right\} \tag{10'}$$

$$\left.\begin{aligned} UBC_{(A)} &= -K_{(A)} \cdot I_{UBC(A)} \\ UBC_{(B)} &= -K_{(B)} \cdot I_{UBC(B)} \\ UBC_{(C)} &= -K_{(C)} \cdot I_{UBC(C)} \end{aligned}\right\} \tag{11'}$$

In the practical processing, the processing shown in FIG. 5 is made for each of the burner flames (A) through (C).

Figure 7:
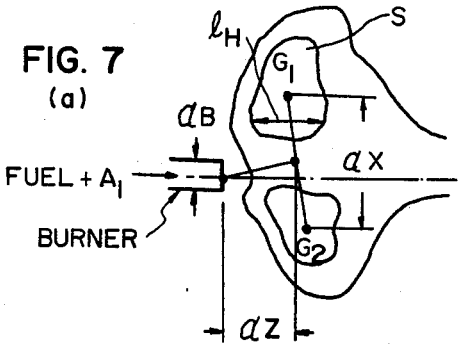
FIGS. 7(*a*) through 7(*c*) are explanatory views for explaining the shape parameters of the flame.
Figure 7:
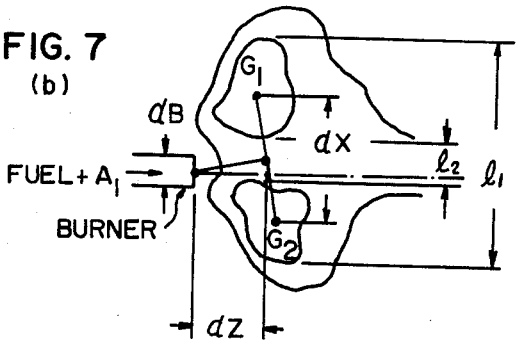

FIG. 7(*a*) shows an example in which $X_3'$ used for the $I_{UBC}$ calculation is expressed by the thickness of the oxidizing flame but not by the primary air quantity. In this example, the thickness of the oxidizing flame is expressed by the formula (12):

$$\text{thickness of oxidizing flame } X_3' = S/lH \tag{12}$$

where

S: area of oxidizing flame, lH: length of oxidizing flame in axial direction of burner.

Here, the length in the axial direction of the burner, through which the position of centroid passes, may be used as lH.

FIG. 7(*b*) shows an example in which the thickness of the oxidizing flame is expressed by the formula (13) or (14):

$$\text{thickness of oxidizing flame } X_3' = l_1/l_2 \quad (13)$$

or $$X_3' = l_1 - l_2 \quad (14)$$

where $l_1$: the remotest distance from the burner center axis between oxidizing flames, $l_2$: the closest distance from the burner center axis between oxidizing flames.

As can be understood from FIGS. 7(*a*) through 7(*c*), the thickness of the oxidizing flame has the same significance as the primary air $A_1$ shown in FIG. 2 as the parameter representing the degree of combustion, but it is greatly affected by throttle during measurement, or the like.

On the other hand, the feature parameter shown in FIG. 7(*c*) does not determine the oxidizing flame position ($X_1$) and the distance between the oxidizing flames ($X_2$) from the positions of centroid, but $X_1$ is determined using the end of the oxidizing flame closest to the burner tip while $X_2$ is determined using the end of the oxidizing flame closest to the burner axis (center line).

Besides the selection of the feature parameters, the essence of the present invention is expressed by the following:

(1) the degree of approaching of the flame to the burner tip ($X_1$);

(2) the degree of approaching of the flames to each other ($X_2$); and (3) the degree of combustion or combustion state ($X_3'$).

In other words, the gist of the present invention resides in that all the parameters extracted from the flame image in the proximity of the burner can be applied as the estimation parameters for the unburnt components in ash $I_{UBC}$. Furthermore, it is naturally necessary to suitably use the four rules of arithmetic in combination without being fixed to the formula (10) or (10') in order to select the parameters.

It is also easily possible to estimate the unburnt components in ash by use of the concept or embodiment of the present invention without using the luminance data but by converting it to the temperature data.

Next, the display of the flame will be described. FIG. 8 shows an example of an image signal stored in the frame memory 15. The display is effected using this data by carrying out the processing shown in FIGS. 9(*a*) and 9(*b*). Though FIG. 8 shows the luminance data, the temperature data may also be used. In this case, the luminance should be converted to the temperature using Wein's formula.

FIG. 9 shows a flow chart of the processing by the processor 16. A luminance histogram is determined using the image data 104 taken into the processor 16 (at step 300). When this luminance histogram is divided into two zones, for example (at step 302), division is made using the following formula (15), for example, because the relation between the temperature and the luminance can be expressed by index functions from Wein's formula:

$$R' = (1 - e^{-a}) \cdot (N - 1) \quad (15)$$

where a: variable (0, 1, . . . ),

N: quantization number of image,

R': divided luminance level.

Figure 11:
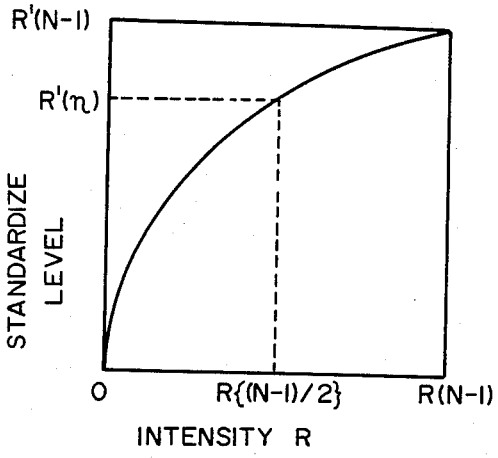
FIG. 11 is a diagram showing the relation between the luminance and a division level when stored in terms of functions.

Alternatively, it is possible to store the function as a curve or broken line as shown in FIG. 11. In this diagram, when the luminance is R (n−1)/2 in order to divide the zone into two zones, the luminance level to be practically divided is R(n). However, it is also possible to divide into intervals having equivalent luminance.

Figure 12:
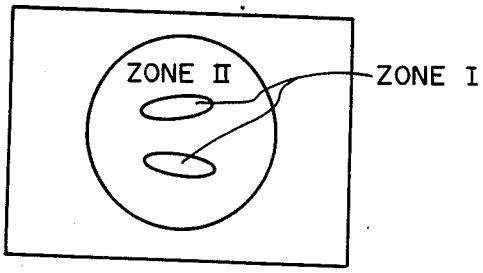
FIG. 12 is an explanatory view showing an example of zone display.

In this manner the zone is divided into the two zones as shown in FIG. 10, and each of the zones is displayed as shown in FIG. 12 (at step 304). Hatching and colors are applied in order to improve visibility (at step 303), thereby further enhancing the effect of the invention.

In the schematic flow chart of FIG. 9(*b*), at least the steps up to the division of the combustion zone into two zones are the same as those in FIG. 9(*a*).

Next, the relation between the combustion state of the flame and each flame zone will be considered. In order for the combustion to continue, oxygen and fuel must be supplied continuously in suitable amounts, and if either of them decreases, the change occurs in the combustion state and its influence appears in the luminance of the flame that represents the activity of combustion. The relation between the luminance and the temperature is described already.

The comparison of the standard zone as the reference that is in advance stored and the divided zones (at step 306) is made using the following formula (16). For example, the areas of the two zones are first determined.

$$\left.\begin{aligned} \text{area } A_1 \text{ of the zone I} &= \sum_{m=n}^{N-1} H(m) \\ \text{area } A_2 \text{ of the zone II} &= \sum_{m=0}^{n=1} H(m) \end{aligned}\right\} \quad (16)$$

$$\text{total area } A = A_1 + A_2 = \text{const.}$$

where

N: quantization number of image,

H(m): frequency of R(m) at luminance, n: number of division level R(n).

The proportion of each area thus determined to the total area is determined using the following formula (17).

$$\left.\begin{aligned} \text{area ratio of zone I, } a_1 &= \frac{A_1}{A_1 + A_2} \times 100\ (\%) \\ \text{area ratio of zone II, } a_2 &= \frac{A_2}{A_1 + A_2} \times 100\ (\%) \end{aligned}\right\} \quad (17)$$

For example, the ratio of each zone can be obtained as follows from formula (17):

$a_1 = b_1$ (%)

$a_2 = b_2$ (%)

Figure 13:
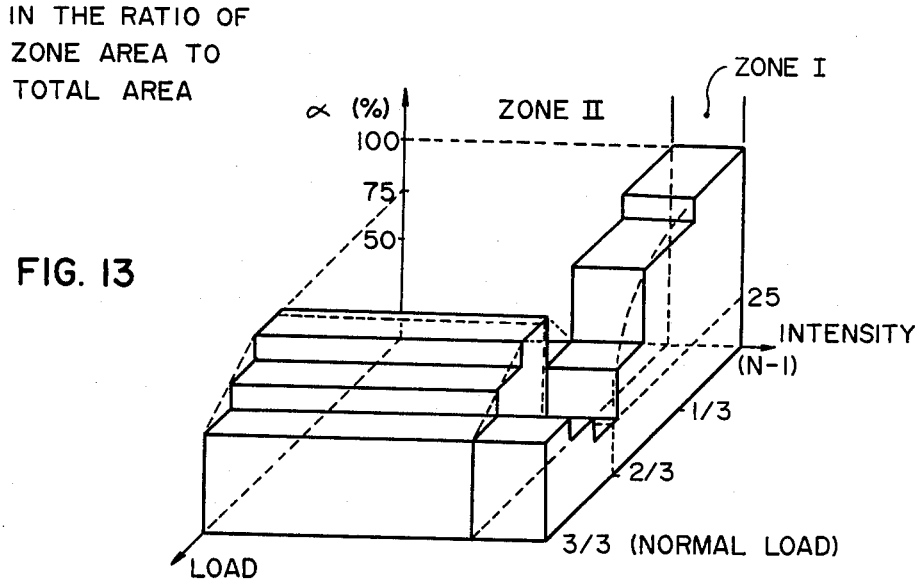
FIG. 13 is an explanatory view showing mosaically the relation between the zones I and II and the load.

If the load in this case is $\frac{2}{3}$ of the rated load, the standard area ratio $\alpha_1$ and $\alpha_2$ of the zones I and II can be obtained as follows from FIG. 13:

$\alpha_1 = 25$ (%)

$\alpha_2=75$ (%)

Next, the comparison is then made (at step 306) whether or not $b_1$ and $b_2$ are within the normal ranges, respectively.

$$\left.\begin{array}{l}\text{error of zone I, } \beta_1 = |\alpha_1 - b_1| \\ \text{error of zone II, } \beta_2 = |\alpha_2 = b_2|\end{array}\right\} \quad (18)$$

Figure 14:
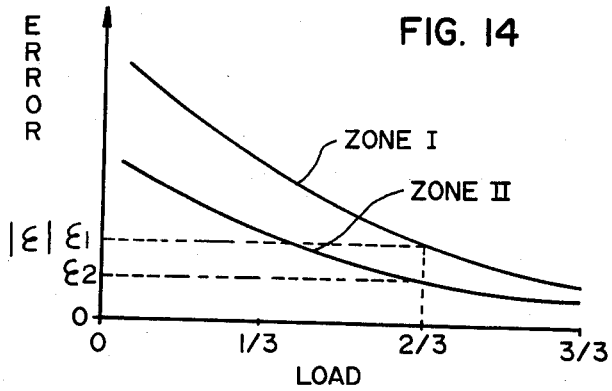
FIG. 14 is a diagram showing the relation between the load and an error.

For example, the error of each zone is determined from the formula (18), and is compared with the error range at that load (FIG. 14) in accordance with the following formula (19).

$$\left.\begin{array}{l}0 \leqq \beta_1 < \epsilon_1 \\ 0 \leqq \beta_2 < \epsilon_2\end{array}\right\} \quad (19)$$

where $\epsilon_1$ and $\epsilon_2$ are the error ranges of the zones I and II, respectively.

If the formula (19) is satisfied (at step 308), "Normal" is produced and if not, "Abnormal" is produced, so that the combustion state with respect to the load change can be supervised satisfactorily from the flame, and the burden to the operator can be drastically reduced.

Furthermore, the effect of the present invention can be obviously enhanced by assembling FIGS. 9(*a*) and 9(*b*).

The accuracy and reliability of supervision can be further improved by determining the mean values of the instantaneous image data and utilizing them.

What is claimed is:

1. In a method of supervising the combustion state of a combustion furnace using a burner consisting of fuel injection nozzles for jetting a mixture of a dust coal fuel and a gas or water and air nozzles for injecting the air for combustion, disposed around said fuel injection nozzles, the improvement comprising:

measuring a sectional image of a flame concentrically formed with the direction of the fuel injected from said burner being the center, and extracting two oxidizing flame zones as high luminance zones;

calculating the shape parameters of said two oxidizing flame zones thus extracted;

calculating and estimating the quantities of NOx formed or unburnt components in ash using said shape parameters thus calculated; and supervising the combustion state of said furnace in accordance with the calculated estimation values.

2. The method of supervising the combustion state according to claim 1 wherein at least the position of centroid of said oxidizing flame is used as said shape parameters of said oxidizing flame zones.

3. The method of supervising the combustion state according to claim 1 wherein at least the distance between the centroids of the two oxidizing flames formed on a flame supervision plane is used as said shape parameters of said oxidizing flame zones.

4. The method of supervising the combustion state according to claim 1 wherein at least the ratio of the circumferential length of said oxidizing flame to its area as an index representing the thickness of said oxidizing flame is used as the shape parameters of said oxidizing flame zones.

5. The method of supervising the combustion state according to claim 1 wherein an index of reduction of NOx is calculated in accordance with the following formula using said shape parameters $X_1$, $X_2$ and $X_3$ of said oxidizing flame zones:

$$I_{NOx}=X_1^{-1}\cdot X_2\cdot X_3^{-1}$$

where $X_1=dZ/dB$, $X_2=dX/dB$, $X_3=l_F/S_F$,

Z: distance from the burner tip to the position of centroid of the flame shape,

B: burner diameter,

X: distance between centroids of flame shapes, $l_F$: circumferential length of flame shape, $S_F$: area of flame shape.

6. The method of supervising the combustion state according to claim 1 wherein an index for reducing the unburnt components in ash $I_{UBC}$ is calculated in accordance with the following formula using $X_3'$ in addition to said shape parameters $X_1$ and $X_2$ of said oxidizing flame zones:

$$I_{UBC}=k\cdot X_1^{-1}\cdot X_2^{-1}\cdot X_3'$$

where k: coefficient, $X_3'$: primary air flow rate.

7. The method of supervising the combustion state according to claim 6 wherein the unburnt components in ash discharged from said furnace are estimated from the product of said index for reducing the unburnt components in ash ($I_{UBC}$) and a predetermined coefficient k, and the combustion state is supervised from the estimation value thus obtained.

8. The method of supervising the combustion state according to claim 6 wherein the ratio of the area of said oxidizing flame zone to the length of said flame zone in the fuel injection direction is used in place of said primary air flow rate.

9. The method of supervising the combustion state according to claim 6 wherein the ratio of both distances between the remotest points of said two oxidizing flame zones from the axis of fuel injection of said burner and their closest points to said axis is used in place of said primary air flow rate.

10. The method of supervising the combustion state according to claim 9 wherein the difference between both of said distances is employed.

11. In an apparatus for supervising the combustion state of a combustion furnace using a burner consisting of fuel injection nozzles for jetting a mixture of a dust coal fuel and a gas or water and air nozzles for injecting the air for combustion, disposed around said fuel injection nozzles, the improvement comprising:

means for measuring the flame at a flame root portion in the proximity of said burner;

memory means for converting the measured flame data into a digital quantity and storing said digital quantity;

means for extracting two oxidizing flame zones as high luminance zones using the data read out from said memory means;

means for calculating the parameters of the oxidizing flame shape thus extracted; and means for calculating and estimating an index for reducing NOx or unburnt components in ash using said parameters;

the result of estimation being used for supervising the combustion state of said combustion furnace.

12. The apparatus for supervising the combustion state according to claim 11 wherein the positions of centroids or distance between the centroids of said oxidizing flame zones is calculated as said shape parameter.

13. The apparatus for supervising the combustion state according to claim 11 which further includes means for calculating and estimating $I_{NOx}$ in accordance with the following formula:

$$I_{NOx}=X_1^{-1}\cdot X_2\cdot X_3^{-1}$$

where $X_1=dZ/dB$, $X_2=dX/dB$, $X_3=l_F/S_F$,

Z: distance from the burner tip to the position of centroid of the flame shape,

B: burner diameter,

X: distance between centroids of two flame shapes, $l_F$: circumferential length of flame shape, $S_F$: area of flame shape.

14. The apparatus for supervising the combustion state according to claim 11 which further includes means for calculating said index for reducing the unburnt component in ash $I_{UBC}$ in accordance with the following formula:

$$I_{UBC}=k\cdot X_1^{-1}\cdot X_2^{-1}\cdot x_3'$$

where k: a predetermined coefficient, $X_3'$: primary air flow rate.

15. In a method of measuring the combustion state in a combustion furnace and displaying and supervising the combustion state, the improvement comprising:

measuring a flame root portion in the proximity of a burner outlet;

determining a luminance histogram from the measured luminance data, and dividing a flame zone into a zone having higher luminance and a zone having lower luminance than a predetermined reference zone; and displaying the shape of the flame on the basis of the two zones thus divided.

16. The method of supervising the combustion state according to claim 15 wherein a reference temperature corresponding to the measured luminance signal is determined in advance, and the flame zone is divided into a zone having a higher temperature and a zone having a lower temperature than said reference temperature.

17. The method of supervising the combustion state according to claim 15 wherein the ratio of each of said divided zones to the total area is calculated, and the combustion state is supervised depending upon whether or not said ratio exceeds an allowable value determined in accordance with a load to said combustion furnace.

* * * * *